US006895915B2

(12) United States Patent
Hemphill

(10) Patent No.: US 6,895,915 B2
(45) Date of Patent: May 24, 2005

(54) DIRECT DRIVE CRANKING SYSTEM FOR BELT OR CHAIN-DRIVEN V-TWIN MOTORCYCLE ENGINES

(76) Inventor: Lewis Hemphill, 20310 Fuero Dr., Walnut, CA (US) 91789

( * ) Notice: Subject to any disclaimer, the term of this patent is extended or adjusted under 35 U.S.C. 154(b) by 0 days.

(21) Appl. No.: 10/649,143

(22) Filed: Aug. 26, 2003

(65) Prior Publication Data

US 2005/0045136 A1 Mar. 3, 2005

(51) Int. Cl.[7] ..... F02N 11/00

(52) U.S. Cl. ..... 123/179.25; 74/7 C; 74/7 E; 29/888.011

(58) Field of Search ..... 123/179.25; 74/7 C, 74/7 E; 29/888.011

(56) References Cited

U.S. PATENT DOCUMENTS 4,573,364 A * 3/1986 Givan ..... 74/7 E
6,109,121 A * 8/2000 Brown ..... 74/7 E
6,732,694 B2 * 5/2004 Holweg ..... 123/179.25

FOREIGN PATENT DOCUMENTS

DE 100 06 690 C1 * 6/2004 ..... F02N/11/00

* cited by examiner

*Primary Examiner*—Andrew M. Dolinar
(74) *Attorney, Agent, or Firm*—Leonard Tachner

(57) ABSTRACT

A method and apparatus for achieving reliability in starting V-Twin chain or belt-driven motorcycle engines using a conventional motorcycle battery and specially modified automotive cranking motor. The apparatus in its preferred embodiment utilizes a direct drive cranking motor configuration employing a cammed bearing clutch which is placed onto the engine's crankshaft along with a ring gear. The ring gear engages the geared shaft of the cranking motor directly, thereby bypassing the chain or belt-drive and thus effectively removing the main drive chain or belt from the cranking system. The gear ratio between the cranking motor and the ring gear may thus be selected to be optimum for the cranking motor so that the battery and cranking motor may be operated at near optimum power capabilities simultaneously. The method of the invention relates to converting from a remote cranking motor configuration to a direct drive cranking motor configuration to remedy the deficiencies of existing V-Twin chain or belt-driven motorcycle engines.

17 Claims, 5 Drawing Sheets

DIRECT DRIVE CRANKING SYSTEM FOR BELT OR CHAIN-DRIVEN V-TWIN MOTORCYCLE ENGINES

BACKGROUND OF THE INVENTION

1. Field of the Invention

The present invention relates generally to the field of motorcycle engines and more specifically to an improved cranking system for chain or belt-driven V-Twin motorcycle engines in which by employing a direct drive cranking motor configuration, maximum cranking power is achieved for a conventional motorcycle battery.

2. Background Art

Conventional chain or belt-drive V-Twin motorcycle engines employ a chain or belt to transmit power from the engine crankshaft to the transmission and normally employ a cranking motor which is remotely coupled to the engine crankshaft by the belt or chain using an axially movable shaft controlled by a cranking motor clutch and a selected gear reduction from the cranking motor to the crankshaft. Because of typical volume constraints on even the larger motorcycles which employ V-Twin engines, the size of the battery is severely limited. A typical battery for this purpose is a 22 Amp/hour 12 volt battery capable of about 1.6 kW to 1.8 KW maximum energy output. This maximum output of the battery is achieved only at the ideal operating point during cranking which is at a cranking current of about 200 Amps at about 8 volts. Cranking motors are also designed to deliver peak power at 8 volts. The battery power output becomes less than ideal at higher cranking currents because of a further rapid drop in output voltage as does that of the cranking motor. With larger V-Twin engines, it becomes even more critical to operate the battery and cranking motor at their respective maximum efficiencies in order to reliably start the engine. However, because of gear ratios dictated by the nature of the cranking motor, its size and position and the use of a chain or belt drive to link the cranking motor to the crankshaft, the battery and cranking motor are instead operated at very low efficiencies. As a result, the starting cranking power is marginal at best and the current drain on the battery quickly dissipates the available starting energy; a very unfavorable combination. By way of example, a typical V-Twin chain drive motorcycle engine employs a remote cranking motor having a 4.4:1 internal gear reduction which was originally designed for a 10 tooth pinion gear and a 140 to 150 tooth ring gear. This starter should result in an overall gear reduction from the armature of the electric motor in the cranking motor to the crankshaft of about 64 which is typical of automotive applications and presents the near ideal situation. However in a V-Twin chain drive motorcycle, the actual gear ratio is between 21 and 40, resulting in a gear ratio-induced mismatch of between 2 and 3 to 1. Consequently, there is a complete mismatch as well between the battery characteristics, the cranking motor characteristics and the engine cranking requirements. The battery and cranking motor both operate at very low efficiency, resulting in only a small fraction (25%) of the maximum power capability that could be delivered if each of the battery and cranking were operating at their maximum power points. With aftermarket modifications to increase engine output, including using bigger V-Twin engine displacement and the like, this problem has been exacerbated to the point of unreliable starting and the need for frequent cranking motor and cranking motor clutch replacement. Moreover, batteries also require frequent replacement due to repeated extremely high current discharges.

Thus, it would be highly advantageous if there were a convenient way to operate a cranking motor in a V-Twin chain or belt-driven motorcycle engine so that a conventional small size motorcycle battery and cranking motor could more efficiently apply battery cranking power to the crankshaft to more reliably start such an engine. It would also be highly beneficial to find a way to convert the cranking configuration of such engines to achieve that same result.

SUMMARY OF THE INVENTION

The present invention comprises a method and apparatus for achieving reliability in starting V-Twin chain or belt-driven motorcycle engines using a conventional small size motorcycle battery and cranking motor. The apparatus in its preferred embodiment utilizes a direct drive cranking motor configuration employing a cammed bearing clutch which is placed onto the engine's crankshaft along with a 78 tooth ring gear. The ring gear engages the geared shaft of the cranking motor directly, thereby bypassing the chain or belt-drive and thus effectively removing the main drive chain or belt from the starting system. The gear ratio between the cranking motor and the ring gear may thus be selected to be optimum for the cranking motor so that the battery and cranking motor may be operated at near their maximum power points simultaneously.

The cranking motor is located relative to the crankshaft by an arm which is separate from the engine case and crankshaft. The arm is positioned relative to the crankshaft by a first bearing located in the arm. The cranking motor output shaft and its spur gear are positioned relative to the arm by a second bearing located in the arm. In the preferred embodiment, the cranking motor may be enclosed within a sealed compartment containing the chain drive components. This compartment is formed by the union of the inner primary and outer primary castings and contains oil. The cranking motor is sealed to prevent oil from reaching the electrical contact points and armature.

The method of the invention relates to converting from a remote cranking motor configuration to a direct drive cranking motor configuration to remedy the aforementioned deficiencies of existing V-Twin chain or belt-driven motorcycle engines. The steps of the preferred embodiment comprise removing the existing cranking motor, with integral clutch, and the existing ring gear attached to the "clutch basket" and plugging the inner primary casing where the removed cranking motor jack shaft extension entered the casing. Then the crankshaft is modified to receive a cammed bearing clutch and new ring gear and the cranking motor is modified and repositioned with its associated new arm and bearings and new spur gear adjacent the crankshaft within the casing to directly drive the crankshaft for starting with optimum gearing and efficiency.

OBJECTS OF THE INVENTION

It is therefore one principal object of the present invention to provide an improved cranking system for belt and chain-driven V-Twin motorcycle engines.

It is another principal object of the invention to provide a method for converting a remote cranking motor configured V-Twin motorcycle engine to use a direct drive cranking motor.

It is another object of the invention to provide a method and apparatus for improving the reliability of starting a V-Twin belt or chain-driven motorcycle engine.

It is yet another object of the invention to configure the cranking system of a V-Twin belt or chain-driven motorcycle engine to operate at an optimum power condition for a given size battery and cranking motor.

It is still another object of the invention to provide a method for increasing the cranking power applied to the crankshaft of a V-Twin belt or chain-driven motorcycle engine without modifying capability of the commonly used motorcycle battery.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF THE PREFERRED EMBODIMENTS

Figure 1:
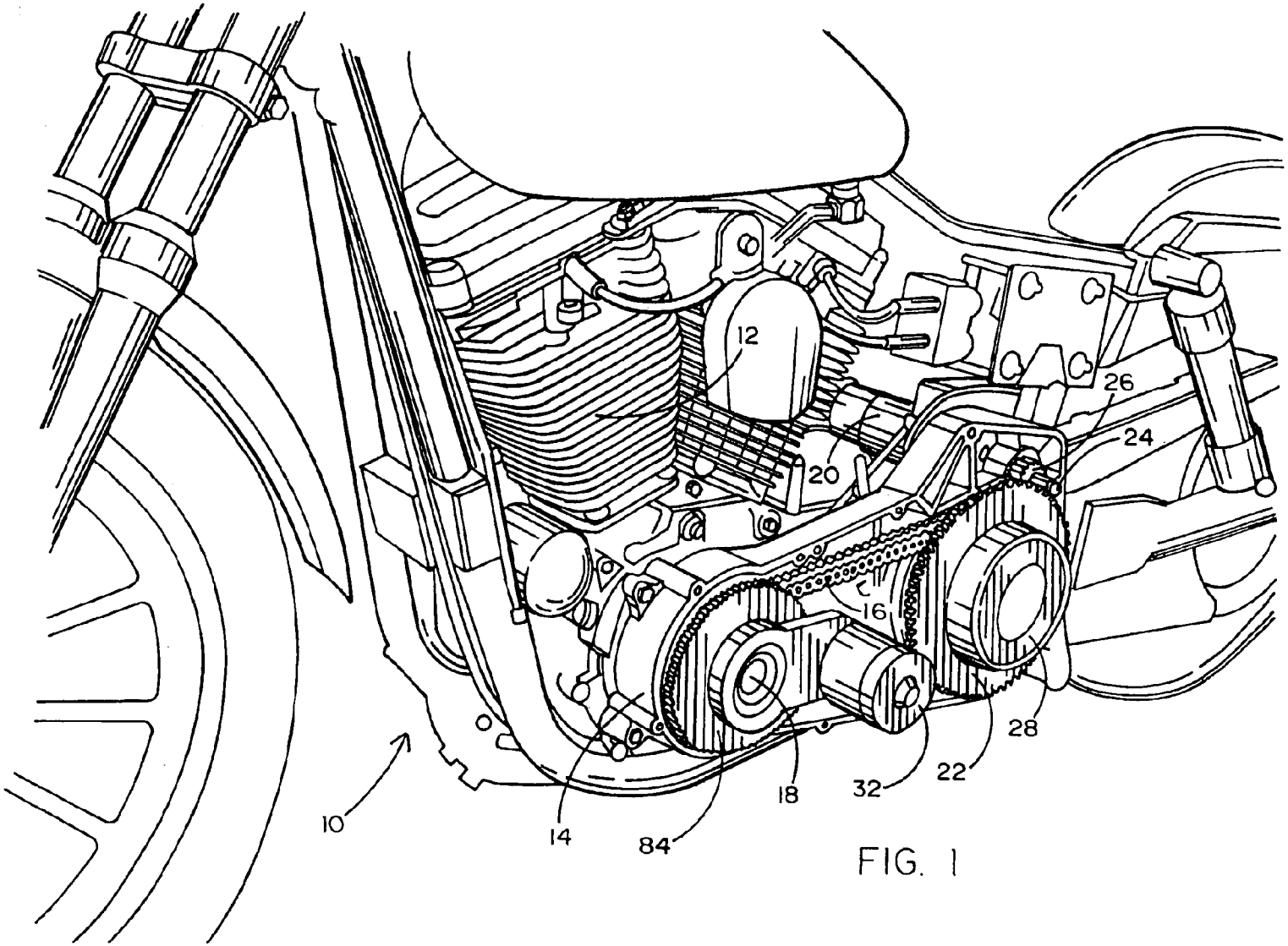
FIG. 1 is a three-dimensional view of the left side of a V-Twin chain-driven motorcycle with the outer primary casing removed and showing both the old and the new cranking system configurations.
Figure 2:
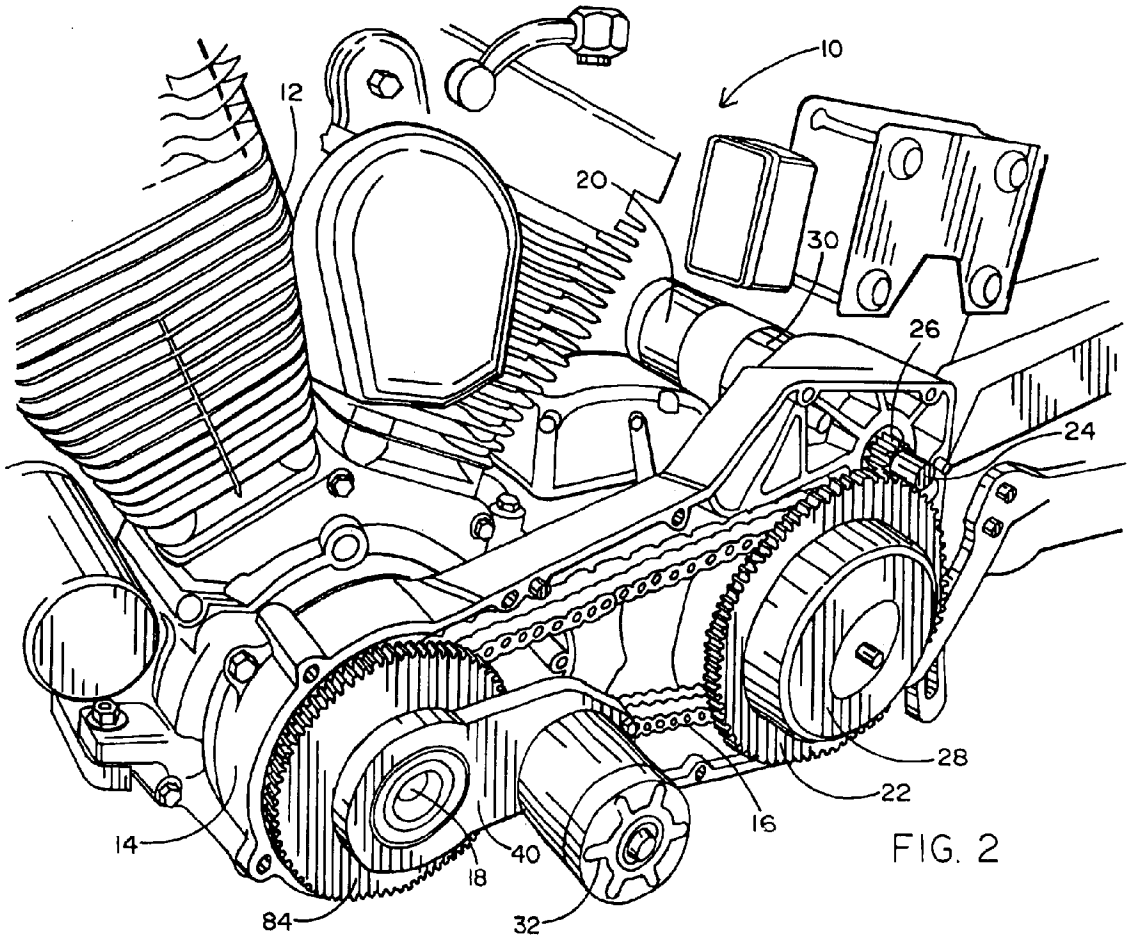
FIG. 2 is an enlarged view of the opened primary casing of a the V-Twin motorcycle of FIG. 1.

Referring to the accompanying drawings and FIGS. 1 and 2 in particular, it will be seen that the invention herein is used primarily on a V-Twin motorcycle 10 having an engine 12 driving a crankshaft 18 in a primary case 14. V-Twin motorcycle 10 is of the type that employs a chain 16 (or belt) coupled to a transmission (not shown) through a main clutch 28. The chain 16 is conventionally driven by an original cranking motor 20 and ring gear 22 to turn over the crankshaft 18 for starting engine 12. The original cranking motor 20 is positioned remote from the crankshaft 18 for selectively driving the original ring gear 22 and chain 16 by means of an original cranking motor shaft extension 24 and original pinion gear 26 selectively actuated through an original, integral cranking motor clutch 30 to linearly translate shaft 24 to engage pinion gear 26 with ring gear 24 and cause chain 16 to rotate the crankshaft 18 and start engine 12.

In the preferred embodiment of the method of the present invention, the original cranking motor 20, original ring gear 22, original cranking motor shaft 24 including pinion gear 26 and original cranking motor clutch 30, are all removed from motorcycle 10. The inner primary case 14 is then plugged to retain the seal integrity of the oil-filled case interior.

Figure 3:
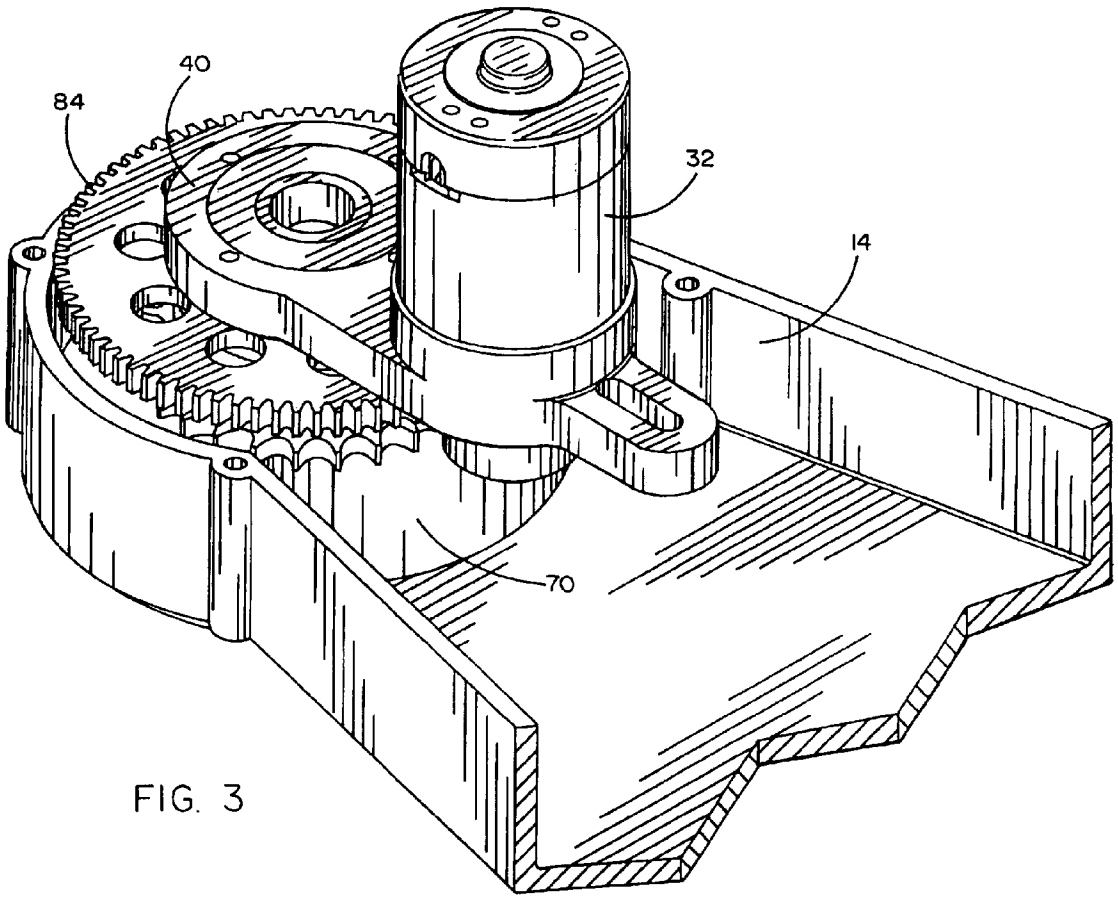
FIG. 3 is an enlarged, partially broken-away view of the cranking system portion of the motorcycle primary casing of FIG. 2.
Figure 4:
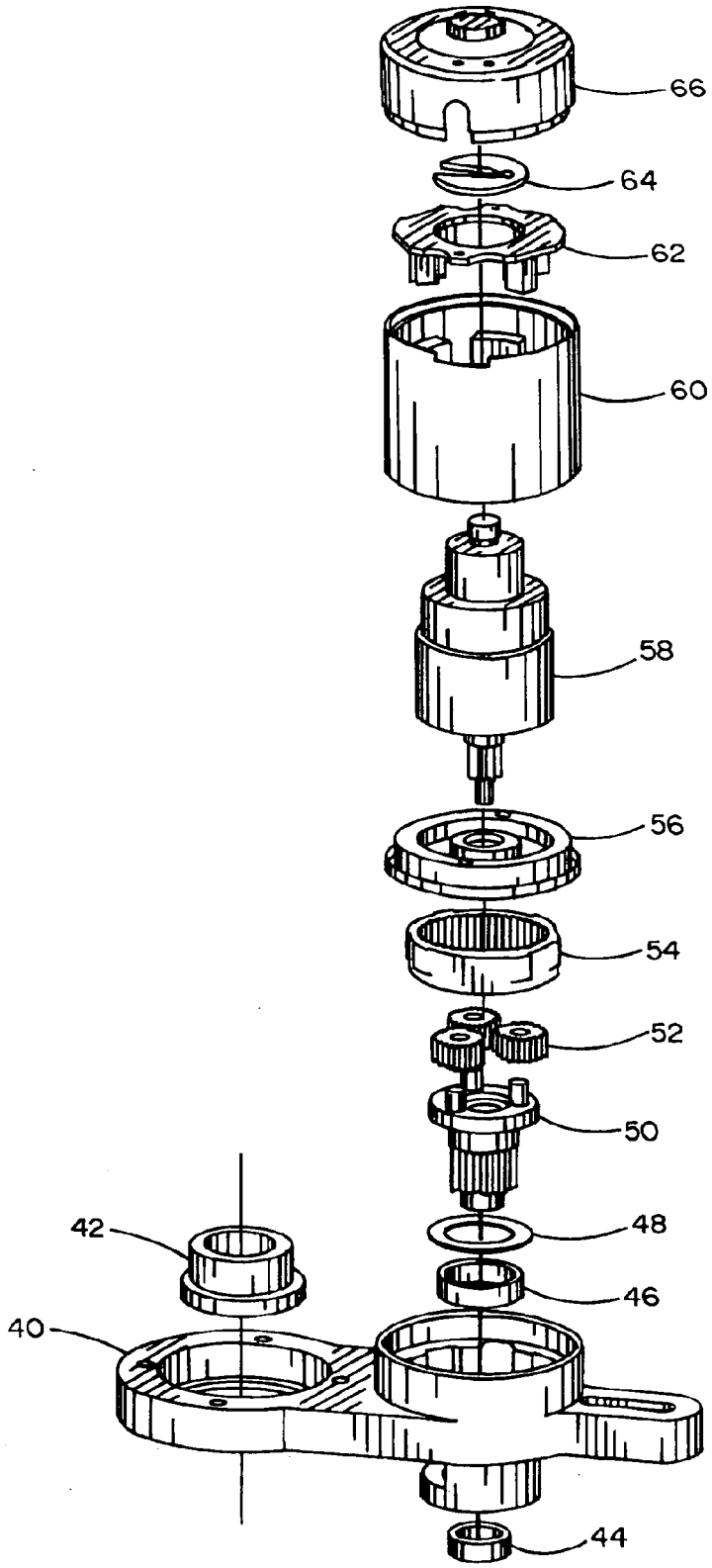
FIG. 4 is an exploded view of the cranking motor portion of the cranking system of the preferred embodiment of the invention.
Figure 5:
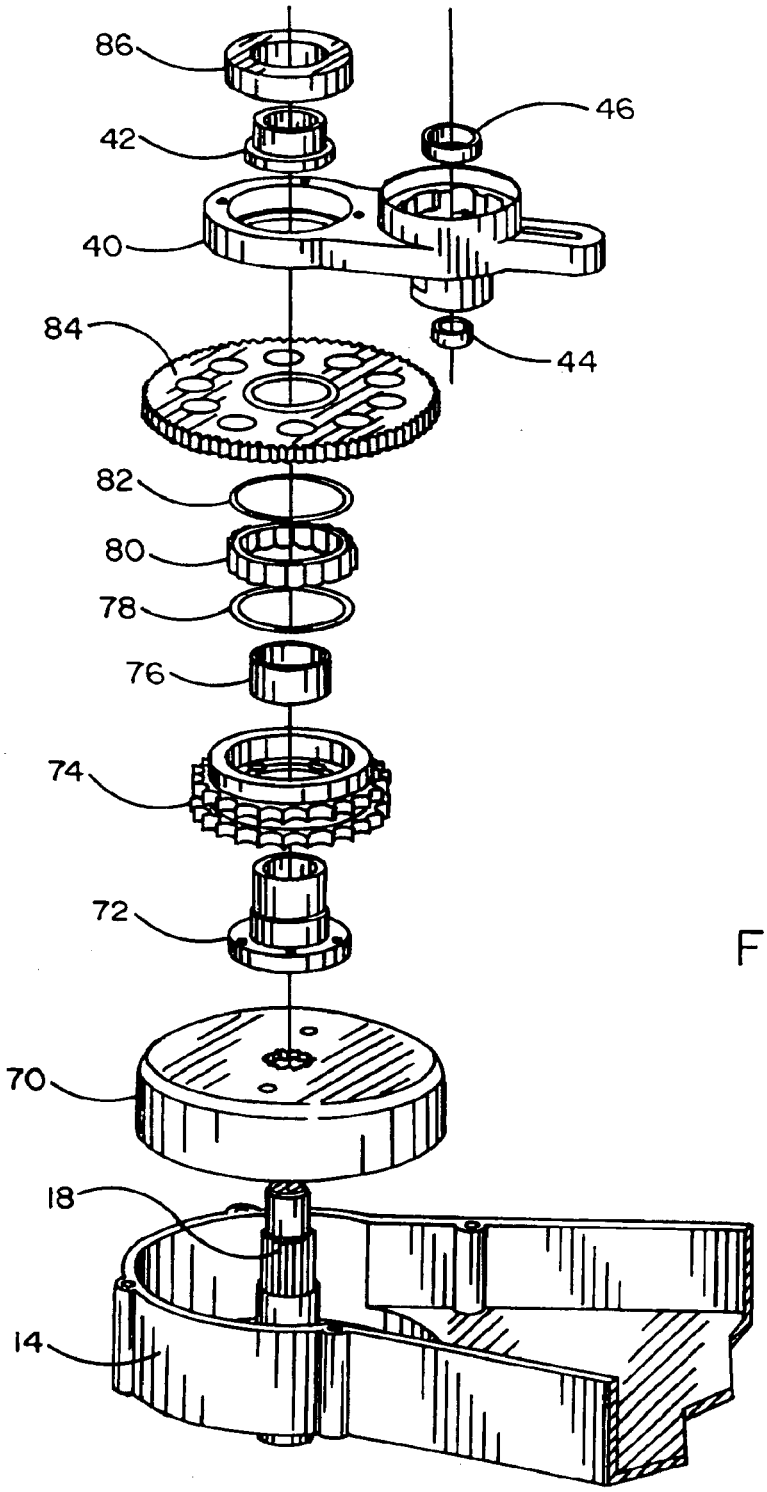
FIG. 5 is an exploded view of the crankshaft portion of the cranking system of the preferred embodiment.

The original crankshaft assembly is next re-configured to the modified assembly shown in FIGS. 3–5 with a replacement starter motor 32. The modified assembly of FIG. 3 is shown exploded in FIGS. 4 and 5, FIG. 4 showing the motor portion of the assembly and FIG. 5 showing the crankshaft portion of the assembly. Both such portions are joined at a common support arm 40.

The cranking motor portion further comprises the following components: inner pinion gear bearing 44, outer pinion gear bearing 46, pinion gear thrust washer 48, pinion gear 50, planet gears 52, internal gear 54, yoke seal plate 56, armature 58, yoke 60, brush holder 62, armature retaining lock 64, and housing cap 66. The motor portion may use a modified cranking motor assembly such as a modified Hitachi Cranking Motor Assembly.

The Hitachi rear cover assembly, thrust washer, brush holder assembly and armature assembly are retained.

The yoke assembly is replaced by one that utilizes neodymium magnets in place of the ferrite magnets that are standard in the Hitachi unit. This is done to effect a 35% increase in output torque per Amp draw in the motor (equivalent to an additional 35% gear reduction).

The center bracket is replaced by the cranking motor yoke seal plate 56. This is necessitated by the fact that the planetary gear system in the present invention is operating in oil and the oil must be sealed from the electric motor. (In conventional use, the planetary gear system is filled with grease).

The internal gear and planetary gears of the Hitachi motor are used as is.

The original pinion shaft and pinion assembly are replaced by the pinion gear. This is because the Hitachi pinion shaft and pinion assembly are integral parts of a clutch assembly which the present invention does not use.

The magnetic switch assembly and shift lever set in the Hitachi motor are not used in the present invention.

The magnetic switch assembly in the Hitachi motor performs two functions. It electrically connects the battery voltage to the brush assembly by means of a high current switch, operated by the solenoid, when the solenoid is activated by a low current starting voltage contactor (the ignition key starting function). The solenoid simultaneously performs the function, acting through the shift lever set, of extending the pinion assembly outward to engage with a standard type automotive ring gear. However, in the present invention pinion gear 50 is in constant engagement with the ring gear 84. Therefore, pinion gear 50 does not need to be extended and hence there is no need for the solenoid action. However, the need for a high current switch still exists. An external cranking motor relay is used for this purpose.

The gear case assembly in the Hitachi starter is for conventional automotive applications. Its function is replaced by the Starter Motor Support Arm 40.

The crankshaft portion further comprises the following components: splined sprocket adapter 72, engine sprocket and clutch housing 74, ring gear support and bearing 76, thrust washer 78, sprag clutch 80, retainer lock ring 82, ring gear 84 and arm bearing 86. When fully assembled, the new or revised cranking motor assembly has the appearance shown in FIG. 3 wherein the pinion gear 50 directly engages the new ring gear 84. The key addition making a direct drive cranking configuration possible is sprag freewheel overrunning clutch 80. Also shown is a standard alternator rotor 70. Adapter 72 and housing 74 may be combined into a single component.

Freewheels are precision clutches which positively lock to transmit torque in one direction of rotation, but are totally released in the opposite direction. In the overrunning mode of operation the output can rotate faster than the input or continue to rotate if the input is stopped. Should the input drive be reversed there will be no drive to the output. Sprag clutches comprise plain diameter inner and outer races with individual spring-loaded sprags between the races. A light spring assures constant contact between the sprags and the races. Torque is transmitted by the wedging action of the sprags between driving and driven components, respectively. The sprags are formed so that respective distances across the diametrically opposite corners are less than the radial gap and greater than the radial gap, respectively. The spring load pushes the sprag towards engaging the longer side. When the outer race is rotated in one direction, frictional drag between the races and the sprag work against the spring turning the sprag to its short length and thereby allowing the races to run free. However, when the outer race is driven in the other direction, frictional drag between races and the sprag rotates the sprag to a locking position where the sprag length exceeds the radial gap, and torque is transmitted between the driving and driven shafts.

The apparatus of the present invention comprises the direct drive cranking configuration of FIG. 3 in a chain or belt-driven V-Twin motorcycle engine wherein conventionally the chain or belt is otherwise used to mechanically couple a remotely-positioned cranking motor to the crankshaft. It will be understood that by employing a direct drive cranking motor configuration, the gear reduction ratio between cranking motor and crankshaft can be made far more suitable for efficient operation of the cranking motor and the existing conventional size battery. Moreover, by effectively removing the belt or chain from the cranking assembly, starting is far more smooth and reliable. Furthermore, by obviating the conventional cranking motor clutch to translate the cranking motor drive shaft, the motorcycle is likely to be more reliable and need repair less frequently. Having thus disclosed preferred embodiments of the method and apparatus of the present invention, what is claimed herein shall be limited only by the appended claims and their equivalents.

I claim:

1. In a belt or chain-driven motorcycle having a V-Twin engine with an extended crankshaft and having a battery and a cranking motor powered by the battery for rotating the crankshaft to start the engine; a direct drive cranking system comprising:

a ring gear affixed to said crankshaft for rotating said crankshaft;

a sprag freewheel clutch mounted to said crankshaft in an overrunning operating configuration;

a cranking motor support arm having first and second support bearings located along parallel axes, one of said axes being co-axial with said crankshaft, said first support bearing receiving a free end of said crankshaft in rotational engagement; and a cranking motor having a driven pinion gear for engaging said ring gear with a selected gear ratio, said pinion gear being received in said second support bearing along the other of said parallel axes.

2. The direct drive cranking system recited in claim 1 further comprising an engine sprocket gear affixed to said crankshaft for driving said belt or chain; said sprocket gear forming a portion of said sprag freewheel clutch.

3. The direct drive cranking system recited in claim 1 wherein said gear ratio is selected to operate said cranking motor and battery at about their maximum power points.

4. The direct drive cranking system recited in claim 1 wherein said cranking motor, said ring gear, said sprag freewheel clutch and said support arm are enclosed in an oil-filled sealed housing which also encloses one end of said crankshaft.

5. The direct drive cranking system recited in claim 1 wherein said pinion gear is driven by three planetary gears in said cranking motor.

6. In a belt or chain-driven motorcycle having a V-Twin engine with an extended crankshaft and having a battery and cranking motor powered by the battery for rotating the crankshaft to start the engine; a direct drive cranking system comprising:

a ring gear affixed to said crankshaft for rotating said crankshaft;

a cranking motor having an output shaft mounted in adjacent parallel relation to said crankshaft for directly engaging said ring gear with a selected gear ratio; and a clutch for selectively engaging said cranking motor to said crankshaft.

7. The direct drive cranking system recited in claim 6 further comprising a sprocket gear for driving said belt or chain; said sprocket gear forming a portion of said clutch.

8. The direct drive cranking system recited in claim 6 wherein said gear ratio is selected to operate said cranking motor and said battery near their maximum power capabilities simultaneously.

9. The direct drive cranking system recited in claim 6 wherein said cranking motor, said ring gear and said clutch are enclosed in an oil-filled sealed housing which also encloses an end of said crankshaft.

10. The direct drive cranking system recited in claim 6 wherein said cranking motor comprises a pinion gear driven by three planetary gears in said cranking motor.

11. A method for converting a belt or chain-driven V-Twin engine motorcycle from a remote cranking system having an existing cranking motor remotely coupled to a motor crankshaft to a direct drive cranking system; the method comprising the steps of:

a) removing the existing cranking motor, integral cranking motor clutch and ring gear;

b) affixing a sprag freewheel clutch to the motor crankshaft;

c) affixing a new ring gear to the sprag freewheel clutch; and d) positioning a cranking motor having a pinion gear to allow said pinion gear to engage said new ring gear.

12. The method recited in claim 11 further comprising the step of selecting the new ring gear and the pinion gear to provide a gearing ratio corresponding to operating conditions of the cranking motor and battery that allows the maximum amount of cranking power to be delivered to the crankshaft.

13. The method recited in claim 11 further comprising the step of modifying the cranking motor of step d) to provide increased cranking torque per unit starting current.

14. A method for converting a belt or chain-driven V-Twin engine motorcycle from a remote cranking system having an existing cranking motor remotely coupled to a cranking motor to a direct drive cranking system; the method comprising the steps of:

a) removing the existing cranking motor, integral cranking motor clutch and ring gear;

b) affixing an overrunning clutch to the motor crankshaft;

c) affixing a new ring gear to the overrunning clutch; and d) positioning a cranking motor having a pinion gear to engage said new ring gear with said pinion gear.

15. The method recited in claim 14 further comprising the step of modifying the cranking motor of step d) to provide increased starting torque per unit starting current.

16. The method recited in claim 14 further comprising the step of selecting the new ring gear and the pinion gear to provide a gearing ratio corresponding to operating conditions of the cranking motor and battery that allows the maximum amount of cranking power to be delivered to the crankshaft.

17. A method for converting a belt or chain-driven V-twin engine motorcycle from a remote cranking system having an existing cranking motor remotely coupled to a motor crankshaft to a direct drive cranking system; the method comprising the steps of:

a) removing the existing cranking motor, integral motor clutch and ring gear;

b) affixing a new ring gear to the crankshaft;

c) positioning a cranking motor adjacent said crankshaft and having a pinion gear to allow said pinion gear to directly engage said new ring gear; and d) providing a clutch for selective engagement and disengagement of said cranking motor and said crankshaft.

* * * * *